US005212959A

United States Patent [19]

Galbreath, Sr.

[11] Patent Number: 5,212,959

[45] Date of Patent: May 25, 1993

[54] REFRIGERANT PROCESSING AND TRANSFERRING SYSTEM

[76] Inventor: Charles E. Galbreath, Sr., P.O. Box 507, Westlake, La. 70669

[21] Appl. No.: 893,007

[22] Filed: Jun. 3, 1992

[51] Int. Cl.[5] ..... F25B 45/00

[52] U.S. Cl. ..... 62/292; 62/475

[58] Field of Search ..... 62/77, 85, 292, 195, 62/149, 475

[56] References Cited

U.S. PATENT DOCUMENTS

| | | | |
|---|---|---|---|
| 4,476,688 | 10/1984 | Goddard | 62/292 |
| 4,981,020 | 1/1991 | Scuderi | 62/77 |
| 4,998,416 | 3/1991 | Van Steenburgh, Jr. | 62/292 |
| 5,001,908 | 3/1991 | Mayer | 62/470 |
| 5,022,230 | 6/1991 | Todack | 62/77 |

*Primary Examiner*—John M. Sollecito
*Attorney, Agent, or Firm*—Richard C. Litman

[57] ABSTRACT

A refrigerant and transfer system has a vapor suction inlet connector to introduce refrigerant from a refrigerant line of a refrigerant system under repair containing refrigerant in vapor form to an input end of a first fluid path which pumps the refrigerant to its output end. The first fluid path has a filter and drying stage, a high pressure compressor, and an oil separator to purify the refrigerant passing therethrough. The refrigerant is then passed to a condenser and stored in a receiver tank of the receiver section. If the refrigerant line of the refrigerant system under repair contains a refrigerant in liquid form, then the refrigerant line should be connected to a liquid refrigerant connector of the refrigerant processing and transferring system. The refrigerant is then stored in a receiver tank of the receiver section. The refrigerant can be further processed by transferring the refrigerant from one receiver tank to another using the first fluid path.

11 Claims, 2 Drawing Sheets

REFRIGERANT PROCESSING AND TRANSFERRING SYSTEM

BACKGROUND OF THE INVENTION

1. Field of the Invention

The present invention relates to a refrigerant processing and transferring system for recovering the refrigerant from a refrigeration system during repairs, separating contaminants from the refrigerant removed from the refrigeration system, and then returning the processed refrigerant to the repaired refrigeration system.

2. Description of the Prior Art

Refrigerant recovery systems are used to prevent the loss of refrigerants in refrigerant systems when the refrigerant has to be removed in order to effect repairs. Due to the increase in the cost of refrigerants, as well as the growing concern on the adverse effects refrigerants have on the environment when discharged into the atmosphere, refrigerant recovery systems have been used to remove and store the refrigerants of refrigerant systems under repair. Most refrigerant systems also include some scheme for removing contaminates from the removed refrigerant before transferring the processed refrigerant back to the repaired refrigerant system.

U.S. Pat. No. 4,981,020 issued Jan. 1, 1991 to Carmerlo J. Scuderi discloses a refrigerant recovery system using a filter dryer to remove moisture and particulate contaminants from the removed refrigerant. The processed refrigerant is then sent to a discriminator chamber to direct vaporous refrigerants to a condenser before being stored in a receiver, while liquid refrigerants are channeled directly to the receiver.

U.S. Pat. No. 4,998,416 issued Mar. 12, 1991 to Van Steenburgh, Jr. discloses a refrigerant recovery system using a filter dryer, oil separator, a condenser, and a compressor.

U.S. Pat. No. 5,001,908 issued Mar. 26, 1991 to Donald K. Mayer discloses a refrigerant recovery system in which an oil separator recycles some of the oil recovered from the refrigerant to the crankcase of the compressor.

U.S. Pat. No. 5,022,230 issued Jun. 11, 1991 to James J. Todack discloses a portable refrigerant recovery system designed to retrieve, clean, filter, transfer, and reclaim refrigerants such as refrigerant R-11, R-12, R-114, R-500, and R-502.

None of the above inventions and patents, taken either singly or in combination, is seen to describe the instant invention as claimed.

SUMMARY OF THE INVENTION

The refrigerant processing and transferring system of the present invention is used to recover and purify a wide variety of the most commonly used refrigerants, by filter dryers, oil separators, and condensers. The processed refrigerant in virtually new condition is thus suitable for reintroduction to the repaired refrigerant system. The system is portable and the only external utility needed is electricity.

The present invention is capable of handling refrigerants of the CFC and HCFC class, from high pressures to low pressures, up to two-hundred and seventy-five (275) PSIG and as low as twenty-eight (28) inches. A low pressure compressor (LPC) is provided for low pressure refrigerants and also provides for the evacuation of the system. This compressor also acts as a booster for the high pressure compressor (HPC) of the system.

While the refrigerant of the system under repair is being recovered into one of the receiver tanks of the present invention, the refrigerant is processed by a filter dryer and oil separator if the refrigerant is processed by a vaporous fluid path of the system handling refrigerants in vapor form or only by a filter dryer if handled by a liquid fluid path of the present system which handles refrigerants in liquid form.

Once the refrigerant of the system under repair is recovered in one of the receivers of the present invention, the processed refrigerant may be moved to another receiver tank through the vaporous fluid path, thus further purifying the already processed refrigerant. This may be repeated several times until the processed refrigerant is sufficiently completely free of contaminates.

Accordingly, it is a principal object of the invention to provide a refrigerant transfer and recovery system able to handle a wide variety of the most commonly used refrigerants.

It is another object of the invention to provide a refrigerant transfer and recovery system having both a LPC and a HPC.

It is a further object of the invention to provide a refrigerant transfer and recovery system having a plurality of fluid paths for recovering and delivering refrigerants in both liquid and vapor form.

Still another object of the invention is to provide a refrigerant transfer and recovery system having two receiver tanks for transferring the refrigerant from one receiver to another, while further purifying the refrigerant during each transfer operation.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
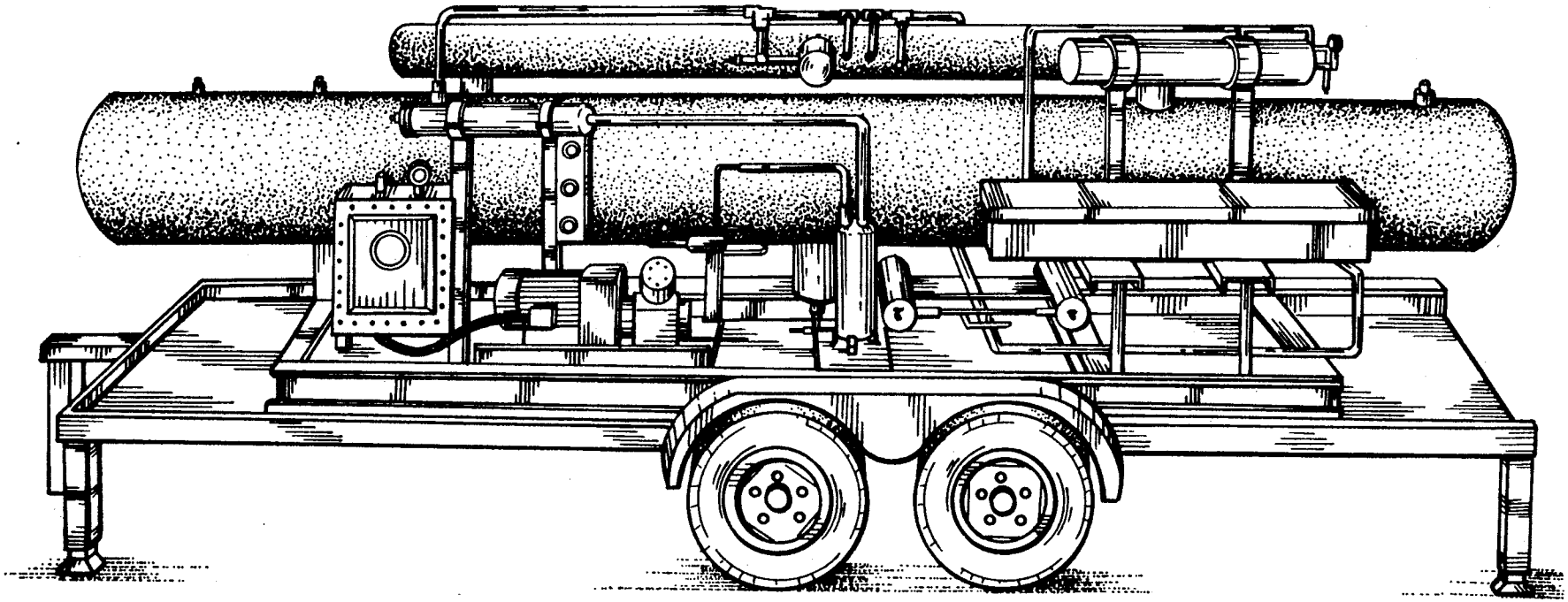
FIG. 1 is a perspective view of the present invention.

As shown in FIG. 1, the present invention may include, but is not limited to, a self contained unit skid mounted on a trailer to be easily transported to the cite of the refrigeration system under repair (not shown). A suitable electrical power supply is the only external utility needed at the cite.

Figure 2:
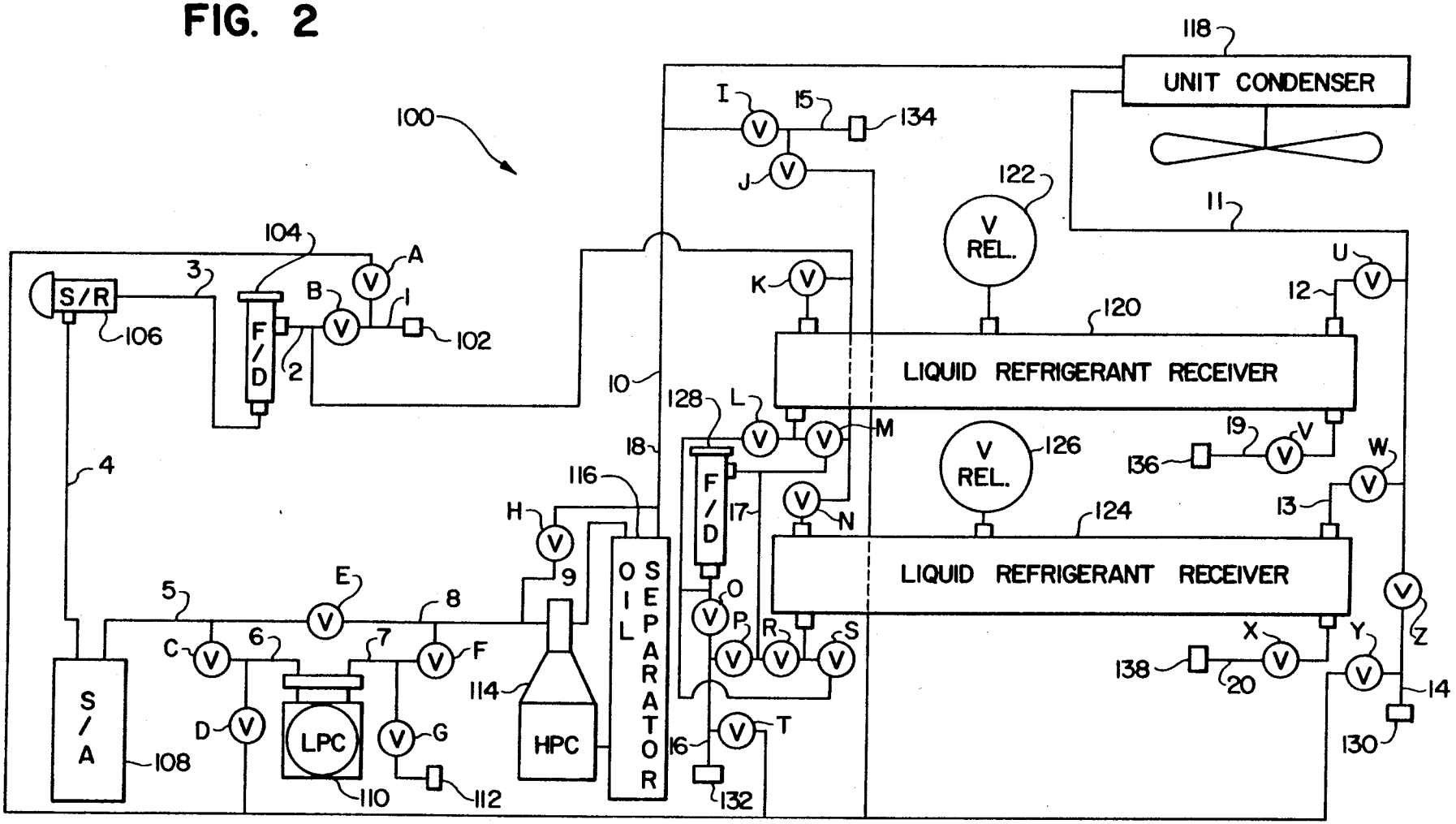
FIG. 2 is a block diagram view of the present invention.

If the refrigerant system under repair is a pump down system, a vapor suction inlet connector 102 is used to connect the refrigerant processing and transfer system 100 to a refrigerant line of the refrigerant system under repair, as shown in FIG. 2. This is done by connecting one end of a hose to the refrigerant line through which the refrigerant is to be removed and the other end of the line to the vapor suction inlet connector 102. The inlet connector 102 introduces the refrigerant to the input end of a first fluid path of the system designed to handle refrigerants in vapor form. It is important that the refrigerant line of the refrigerant system under repair to which the vapor suction inlet connector 102 is connected handles refrigerants in vapor form; otherwise, damage to the system will occur.

Once the vapor suction inlet connector 102 is connected to a refrigerant line of the refrigerant system under repair, the LPC 110 is used to pump out the pressure in the refrigeration line down to twenty-five (25) inches of vacuum as described below.

After the refrigerant line is pumped down, a vapor suction inlet valve B is opened along with a LPC bypass valve E and a first receiver condensed inlet valve U. All other valves are closed. With the HPC and unit condenser 118 turned on, vaporous refrigerant enters the vapor suction inlet connector and then the input end of a first fluid path of the system 100. The first fluid path of the system 100 is designed to process the vaporous refrigerant passing therethrough by the use of a filter and dryer stage 128, the HPC 114, and the oil separator stage 116. These are conventional components well-known in the art. As the vaporous refrigerant exits the oil separator stage 116 which is the output of the first fluid path, the refrigerant is under high pressure due to the pumping action of the HPC and has been processed so as to remove moisture and other particle contaminates of the vaporous refrigerant. The processed refrigerant then enters the unit condenser stage 118 of the system 100. As the processed refrigerant is cooled within the unit condenser stage 118, the processed refrigerant is condensed. The unit condenser stage 118 is also a convention unit condenser. The condensed refrigerant is then transferred to a second fluid path which either delivers the condensed refrigerant to a receiver section of the system 100 or blocks the condensed refrigerant from entering the receiver section, which may be directed instead to a condensed refrigerant outlet 130 connected to an external storage area (not shown). Since the first receiver condensed inlet valve U is open, the condensed refrigerant in the second fluid path enters the first liquid refrigerant receiver tank 120.

As stated above, the vapor suction inlet connector 102 allows the refrigerant of the refrigerant system under repair to enter the input end of the first fluid path. The vapor suction inlet connector 102 is connected to the inlet of the vapor suction inlet valve B by a first fluid connection 1, as shown in FIG. 2. The outlet of the vapor suction inlet valve B is connected to the input of the first fluid path beginning with the second fluid connect 2 which is connected to the inlet of a filter and dryer stage (F/D) 104 via a second fluid connection 2. The F/D 104 is a conventional filter and dryer known in the art which removes moisture and particle contaminates from the refrigerant which passes therethrough. A third fluid connection 3 connects the F/D 104 to a conventional suction regulator (S/R) 106, which in turn is connected to a suction accumulator (S/A) 108 via a fourth fluid connection 4. The S/R 106 and S/A 108 are conventional devices known in the art. The outlet of the S/A 108 is connected to the LPC 110 via the fifth fluid path 5 and LPC inlet valve C. The LPC 110 is connected to the HPC 114 via the LPC outlet valve F and an eighth fluid connection 8. The HPC 114 is connected to the oil separator stage 116 via a ninth fluid connection 9.

Some of the oil recovered from the refrigerant passing through the oil separator stage 116 is returned to the HPC. This arrangement is known in the art as illustrated by U.S. Pat. No. 5,001,908 incorporated herein by reference and made of record. The outlet of the oil separator stage 116 defines the first fluid path output end and is connected to a condenser 118 by a tenth fluid path 10. Note that a LPC bypass valve E and an HPC bypass valve H are provided if one or the other compressors is to be effectively removed from the first fluid path. More specifically, to effectively remove the LPC 110, the LPC inlet valve C and the LPC outlet valve F are closed and the LPC bypass valve E is opened. To effectively remove the HPC, the HPC bypass valve H is opened.

As stated above, the processed refrigerant passing through the condenser 118 is condensed and output to a second fluid path which introduces the condensed refrigerant to a receiver section of the system 100 or the condensed refrigerant outlet 130. The receiver section consists of a first liquid refrigerant receiver 120 and a second liquid refrigerant receiver 124. The first receiver condensed inlet valve U is connected to the outlet of the condenser 118 via an eleventh fluid connection 11, which also connects the second inlet valve W, and the condensed refrigerant outlet connector Z to the output of the condenser 118. The outlet of the first receiver condensed inlet valve U is connected to the condensed refrigerant inlet of the first receiver tank 120 via a twelfth fluid connection 12, thereby allowing the condensed refrigerant to enter the first receiver tank 120 when the first receiver condensed inlet valve U is open. The outlet of the second receiver condensed inlet valve W is connected to the condensed refrigerant inlet of the second receiver tank 124. The condensed refrigerant enters the second receiver tank 124 through the open second receiver condensed inlet valve W.

Each liquid refrigerant receiver also has a vapor suction inlet, a liquid refrigerant inlet, and a liquid refrigerant drain outlet. The vapor suction inlet of the first receiver tank 120 is connected to an inlet of a first receiver vapor suction outlet valve K and the vapor suction inlet of the second receiver tank 124 is connected to the inlet of a second receiver vapor suction outlet valve N. Both the outlets of the first receiver vapor suction outlet valve K and second receiver vapor suction outlet valve N are connected to the second fluid connection 2.

The liquid drain outlets of the first receiver tank 120 and the second receiver tank 124 are connected to the first receiver liquid drain valve V to pass any liquid contaminates in the first receiver tank to the first receiver liquid drain connector 136 and to the second receiver liquid drain valve X to pass any liquid contaminates in the second receiver tank to the second receiver liquid drain connector 138, respectively.

The liquid refrigerant inlets of the first receiver tank 120 and the second receiver tank 124 are connected to the outlets of the first receiver liquid refrigerant inlet valve L and the second receiver liquid refrigerant inlet valve S, respectively, as well as the inlets of the first receiver liquid refrigerant outlet valve M and the second receiver liquid refrigerant outlet valve R, also respectively.

As stated above, the condensed refrigerant from the condenser 118 could enter either the first receiver tank 120 if the first receiver condensed refrigerant inlet valve U is open or the second receiver tank 124 if the second receiver condensed refrigerant inlet valve W is open. If they are both closed and a condensed refrigerant outlet connector valve Z is opened, the condensed refrigerant from the condenser outlet would enter the inlet thereof via the eleventh fluid connection 11 and then the condensed refrigerant outlet connector via the outlet thereof and the fourteenth fluid connection 14. If the first receiver condensed refrigerant inlet valve U, the second receiver condensed refrigerant inlet valve W, and the condensed refrigerant outlet connector valve Z are all closed, and the vapor discharge outlet valve I is open, then the processed vapor refrigerant at the first fluid path output end could enter the inlet of the vapor discharge outlet valve I via the tenth fluid connection 10 and then exit the discharge outlet connector 134 via the outlet of the vapor discharge outlet valve I and the fifteenth fluid connection 15.

As mentioned above, the vapor suction inlet connector 102 is connected to one end of a hose connected at a second end to a refrigerant line of the system under repair, if the refrigerant line handles refrigerants in vapor form. If the refrigerant line handles refrigerants in liquid form, then the first end of the hose should not be connected to the vapor suction inlet connector 102, or damage to the refrigerant processing and transferring system 100 will occur. If the refrigerant line of the system under repair handles refrigerants in liquid form, the first end of the hose should be connected to a liquid refrigerant connector 132 of the system 100. In this way, the liquid refrigerant of the system under repair enters the refrigerant receiver section of the system 100 via a third fluid path. The third fluid path includes F/D 128 which processes the liquid refrigerant of the system under repair before the refrigerant enters the receiver section.

More specifically, the liquid refrigerant of the system under repair entering the system 100 through the liquid refrigerant connector 132 enters the inlet of a liquid refrigerant inlet connector valve P passed thereto by a sixteenth fluid connection 16. Note that a liquid refrigerant outlet connector valve O must be closed since the outlet thereof is also connected to the sixteenth fluid connection 16. The liquid refrigerant is then passed to an inlet of the F/D 128 from the outlet of the liquid refrigerant inlet connector valve P passed thereto by a seventeenth fluid connection 17. The processed liquid refrigerant exiting the output of the F/D 128 is passed either to the inlet of the first receiver liquid inlet valve L if it is open, or the inlet of the second receiver liquid inlet valve S if it is open. The first receiver liquid outlet valve M and the second receiver liquid outlet valve R must also be closed since the outlets thereof are also connected to the seventeenth fluid connection 17.

If the refrigerant system under repair was pumped down before failure occurred, the refrigerant will be stored in the refrigerant system receiver or condenser. The refrigerant is transferred to one of the receivers of the receiver section of the system 100. One end of a first hose is connected to the liquid side of the refrigerant receiver or condenser of the system under repair. The other end of the first hose is connected to the liquid refrigerant connector 132. A second hose has one end connected to a vapor area of the receiver or condenser of the refrigerant system under repair and a second end connected to the vapor discharge outlet connector 134. The pressure in each line is pumped down to twenty-five inches of vacuum using the LPC as described below. Afterwards, assuming that the first receiver tank 120 is to store the refrigerant, the liquid refrigerant inlet connector valve P, the first receiver liquid inlet valve L, the first receiver vapor suction outlet valve 6, the LPC bypass valve E, and the vapor discharge outlet valve I are opened.

With the refrigerant process and transfer system started, the liquid refrigerant of the refrigerant system under repair enters the third fluid path and then the receiver section, more specifically the first receiver tank 120. Some of the liquid refrigerant then enters a fourth fluid path including the first receiver vapor suction outlet K and the portion of the second fluid connection leading from the outlet of the first receiver vapor suction outlet K to the inlet of the F/D 104. The portion of the liquid refrigerant from the receiver section entering the input end of the fourth fluid path is in vapor form since the output end of the fourth fluid connection is connected to the first fluid path which reduces the pressure in the receiver section causing the liquid refrigerant therein to boil. The portion of the liquid refrigerant which enters the fourth fluid path and then the first fluid path is discharged through the vapor discharge outlet 134 to the vapor area of the condenser or receiver of the refrigerant system under repair to condense and be pumped back into the liquid refrigerant connector 132. Once all of the refrigerant is pumped into the first receiver tank, then the liquid refrigerant connector valve 132 and the vapor discharge outlet valve 134 are closed. It is to be understood that the refrigerant process and transfer system 100 has the standard indicators for detecting how much liquid refrigerant is located in each receiver tank, whether any more refrigerant is entering the receiver tank being filled, how much moisture is in the refrigerant stored, etc.

If the processed refrigerant stored in the first receiver is not sufficiently completely free of contaminates, e.g. moisture, than the first receiver vapor suction outlet valve K, the LPC bypass valve E, and the second receiver condensed inlet valve W are opened, with all other valves closed. With the system 100 started, the liquid refrigerant in the first receiver tank begins to enter the fourth fluid path and then the first fluid path and then the second fluid path to the second receiver tank 124. When all of the refrigerant is in the second receiver tank 124, the system can be shut down. However, the refrigerant could be directed back to the first receiver in the same manner, except that the second receiver vapor suction outlet valve N would be opened with the first receiver vapor suction outlet valve K closed and the first receiver condensed inlet U would be closed with the second receiver condensed inlet valve W open. This process could be repeated as many times as necessary.

The manner of evacuating the lines connected to the refrigerant system under repair will now be described. All valves are closed except for the pump down valve connected to the line to be evacuated, the compressor pump down inlet valve D, and the compressor pump down outlet valve G connected to an exhaust pump down connector 112. If a line connected to the vapor suction inlet connector 102 is to be evacuated, then the vapor suction inlet pump down valve A is opened. If a line connected to the vapor discharge outlet is to be evacuated, then the vapor discharge outlet pump down valve is opened. If a line connected to the liquid refrigerant connector 132 is to be evacuated, then the liquid refrigerant connector pump down valve is opened. If a line connected to the condensed refrigerant outlet is to be evacuated, then the condensed refrigerant outlet pump down valve is opened. With the appropriate valves opened as discussed above, the LPC is activated and the appropriate line connected to the refrigeration system under repair is evacuated to about twenty-five inches of vacuum.

While the system 100 incorporates normal and conventional safety devices, such as the safety relief valves 122 and 126 which open at a pressure of 300 PSIG, the system 100 should never be left operating unattended.

It is to be understood that the present invention is not limited to the sole embodiment described above, but encompasses any and all embodiments within the scope of the following claims.

I claim:

1. A refrigerant processing and transferring system usable with a refrigerant system under repair, comprising:

a first fluid path for transferring and processing refrigerant in vapor form having an input end for receiving the refrigerant in vapor form at low pressure and an output end for producing a processed vapor refrigerant at high pressure;

a vapor suction inlet connector having a vapor suction inlet valve for selectively connecting and disconnecting the input end of said first fluid path to a refrigerant line of the refrigerant system under repair having refrigerant in vapor form located therein;

a condenser for receiving a refrigerant in vapor form at high pressure at an input end thereof, for condensing the refrigerant therein, and for producing a condensed liquid refrigerant at an output end thereof under high pressure, wherein the output end of said first fluid path is connected to the input end of said condenser;

a liquid refrigerant receiver section for storing refrigerant in liquid form under high pressure;

said first fluid path further comprising:

a filter and dryer stage for filtering and drying refrigerants entering therein from an input end connected thereto and exiting therefrom from an output end connected thereto, wherein the input end thereof is connected to the input end of said first fluid path;

a suction regulator stage having an input end and an output end;

a first fluid connection connecting the filtered and dried refrigerant at the output end of said filter and dryer stage to the input end of said suction and regulator stage; a suction accumulator stage having an input end and an output end;

a second fluid connection connecting the output end of said suction and regulator stage to the input end of said suction accumulator stage;

a low pressure compressor having an input end and an output end;

a low pressure compressor inlet valve having an inlet and an outlet;

a third fluid connection connecting the output end of said suction accumulator to the inlet of said low pressure compressor inlet valve;

a fourth fluid connection connecting the outlet of said low pressure compressor valve to the input end of said low pressure compressor;

a low pressure compressor outlet valve having an inlet and an outlet;

a fifth fluid connection connecting the outlet of said low pressure compressor to the inlet of said low pressure compressor outlet valve;

a high pressure compressor having an input end and an output end;

a sixth fluid connection connecting the outlet of said low pressure compressor outlet valve to the input end of said high pressure compressor;

an oil separator stage having an input end, a first output end for producing the processed vapor refrigerant located at the output end of said first fluid path, and a second output end for circulating some of the oil recovered by the oil separator stage to the high pressure compressor;

a seventh fluid connection connecting the output end of said high pressure compressor to the input end of said oil separator;

a second fluid path for selectively delivering said condensed liquid refrigerant to said liquid refrigerant receiver section and blocking said condensed liquid refrigerant from entering said liquid refrigerant receiver section;

a third fluid path for transferring and processing refrigerant in liquid form from an input end thereof to an output end thereof, wherein said output end thereof is connected to said liquid refrigerant receiver section;

a liquid refrigerant connector having a liquid refrigerant inlet connector valve for selectively connecting and disconnecting the input end of said third fluid path to a refrigerant line of said refrigerant system under repair with refrigerant in liquid form located therein;

a vapor discharge outlet connector having a vapor discharge outlet connector valve for selectively connecting and disconnecting the output end of said first fluid path to a refrigerant line of the refrigerant system having a refrigerant in vapor form located therein; and a fourth fluid path for selectively connecting or disconnecting said liquid refrigerant receiver section to said input end of the first fluid path.

2. A refrigerant processing and transferring system as claimed in claim 1, wherein said first fluid path further comprises:

a low pressure compressor bypass valve having an inlet connected to said third fluid connection and an outlet connected to said sixth fluid connection so as to bypass said low pressure compressor when said low pressure compressor bypass valve is open, said low pressure compressor inlet valve is closed, and said low pressure compressor outlet valve is closed; and a high pressure compressor bypass valve having an inlet connected to said sixth fluid connection and an outlet connected to the output end of said first fluid path so as to bypass said high pressure compressor and said oil separator stage when said high pressure compressor bypass valve is open.

3. A refrigerant processing and transferring system usable with a refrigerant system under repair, comprising:

a first fluid path for transferring and processing refrigerant in vapor form having an input end for receiving the refrigerant in vapor form at low pressure and an output end for producing a processed vapor refrigerant at high pressure;

a vapor suction inlet connector having a vapor suction inlet valve for selectively connecting and disconnecting the input end of said first fluid path to a refrigerant line of the refrigerant system under repair having refrigerant in vapor form located therein;

a condenser for receiving a refrigerant in vapor form at high pressure at an input end thereof, for condensing the refrigerant therein, and for producing a condensed liquid refrigerant at an output end thereof under high pressure, wherein the output end of said first fluid path is connected to the input end of said condenser;

a liquid refrigerant receiver section for storing refrigerant in liquid form under high pressure;

said liquid receiver section comprising a first receiver tank and a second receiver tank;

a second fluid path for selectively delivering said condensed liquid refrigerant to said liquid refrigerant receiver section and blocking said condensed liquid refrigerant from entering said liquid refrigerant receiver section;

a third fluid path for transferring and processing refrigerant in liquid form from an input end thereof to an output end thereof, wherein said output end thereof is connected to said liquid refrigerant receiver section;

said third fluid path further comprising:

a first receiver liquid refrigerant inlet valve for selectively connecting and disconnecting the output end of said third fluid path to said first receiver tank;

a second receiver liquid refrigerant, inlet valve for selectively connecting and disconnecting the output end of said third fluid path to said second receiver tank;

a filter and dryer stage for receiving the refrigerant in liquid form at an input end thereof connected to the input end of said third fluid path, for filtering and drying refrigerant therein, and for producing a filtered and dried refrigerant at the output end thereof connected to the output end of said third fluid path;

a liquid refrigerant connector having a liquid refrigerant inlet connector valve for selectively connecting and disconnecting the input end of said third fluid path to a refrigerant line of said refrigerant system under repair with refrigerant in liquid form located therein;

a vapor discharger outlet connector having a vapor discharge outlet connector valve for selectively connecting and disconnecting the output end of said first fluid path to a refrigerant line of the refrigerant system having a refrigerant in vapor form located therein;

a fourth fluid path for selectively connecting or disconnecting said liquid refrigerant receiver section to said input end of said first fluid path;

a fifth fluid path for transferring and processing refrigerant in liquid form entering from an input end thereof connected to said liquid refrigerant receiver section and exiting from an output end thereof connected to said liquid refrigerant connector; and said liquid refrigerant connector further comprising a liquid refrigerant outlet connector valve for selectively connecting and disconnecting the output end of said fifth fluid path to said liquid refrigerant connector.

4. A refrigerant processing and transferring system as claimed in claim 3, wherein said fifth fluid path comprises:

a first receiver liquid refrigerant outlet valve for selectively connecting and disconnecting the input end of said fifth fluid path to said first receiver tank;

a second receiver liquid refrigerant outlet valve for selectively connecting and disconnecting the input end of said fifth fluid path to said second receiver tank; and said filter and dryer stage having the input thereof connected to the input end of said fifth fluid path and the output end thereof connected to the output end of said fifth fluid path.

5. A refrigerant processing and transferring system usable with a refrigerant system under repair, comprising:

a vapor suction inlet connector for connecting said refrigerant processing and transferring system to a refrigerant line of said refrigerant system under repair, said refrigerant line containing a vaporous refrigerant therein;

a vapor suction inlet valve having an inlet and an outlet;

a first fluid connection between said first connector and the inlet of said vapor suction inlet valve;

a first filter and dryer stage having an inlet and an outlet;

a second fluid connection between the outlet of said vapor suction inlet valve and said inlet of said first filter and dryer stage;

a suction regulator stage having an inlet and an outlet;

a third fluid connection between the outlet of said first filter and dryer stage and the inlet of said suction regulator stage;

a suction accumulator stage having an inlet and an outlet;

a fourth fluid connection between the outlet of said suction regulator stage and the inlet of said suction accumulator stage;

a low pressure compressor having an inlet and an outlet;

a low pressure compressor inlet valve having an inlet and an outlet;

a low pressure compressor outlet valve having an inlet and an outlet;

a low pressure compressor bypass valve having an inlet and an outlet;

a fifth fluid connection between the outlet of said suction accumulator stage, the inlet of said low pressure compressor inlet valve, and the inlet of said low pressure compressor bypass valve;

a sixth fluid connection between the outlet of said low pressure compressor inlet valve and the inlet of said low pressure compressor;

a seventh fluid connection between the outlet of said low pressure compressor and the inlet of said low pressure compressor outlet valve;

a high pressure compressor having an inlet and an outlet;

an eighth fluid connection between the outlet of said low pressure compressor bypass valve, the outlet of said low pressure compressor outlet valve, and the inlet of said high pressure compressor;

an oil separator stage having an inlet, an outlet, and means for circulating some of the oil recovered from the vaporous refrigerant passing therethrough to the high pressure compressor;

a ninth fluid connection between the outlet of said high pressure compressor and the inlet of said oil separator;

a condenser stage for condensing vapor refrigerant therein having an inlet for receiving a vapor refrigerant and an outlet for producing a condensed liquid refrigerant therefrom;

a tenth fluid connection between the outlet of said oil separator and the inlet of said condenser;

a first receiver tank having a condensed refrigerant inlet;

a first receiver condensed refrigerant inlet valve having an inlet and an outlet;

an eleventh fluid connection between the outlet of said condenser stage and the inlet of said first receiver condensed refrigerant inlet valve;

an twelfth fluid connection between the outlet of said first receiver condensed refrigerant inlet valve and the condensed refrigerant inlet of said first liquid refrigerant receiver.

6. A refrigerant process and transfer system as claimed in claim 5, further comprising a high pressure compressor bypass valve having an inlet connected to said eighth fluid connection and an outlet connected to said tenth fluid connection.

7. A refrigerant processing and transferring system as claimed in claim 6, further comprising:

a compressor pump down inlet valve having an outlet connected to said sixth fluid connection and an inlet;

a vapor suction inlet pump down valve having an inlet connected to said first fluid connection and an outlet;

a pump down fluid connection between the inlet of said compressor pump down inlet valve and the outlet of said vapor suction inlet pump down valve;

a compressor pump down outlet connector;

a compressor pump down outlet valve having an inlet connected to said seventh fluid connection and an outlet connected to said compressor pump down outlet connector;

8. A refrigerant processing and transferring system as claimed in claim 7, further comprising:

a second receiver tank having a condensed refrigerant inlet;

a second receiver condensed refrigerant inlet valve having an inlet connected to said eleventh fluid connection and an outlet;

a thirteenth fluid connection between the condensed refrigerant inlet of said second receiver tank and the outlet of said second receiver condensed refrigerant inlet valve; and a first safety relief valve and a second safety relief valve connected to the first receiver and the second receiver, respectively, each releasing the pressure within their respective receivers when the pressure therein reaches three-hundred pounds per square inch.

9. A refrigerant processing and transferring system as claimed in claim 8, further comprising:

a condensed refrigerant outlet connector;

a condensed refrigerant outlet connector valve having an inlet connected to said eleventh fluid connection and an outlet;

a fourteenth fluid connection connected between said condensed refrigerant outlet connector and the outlet of said condensed refrigerant outlet connector valve;

a vapor discharge outlet connector;

a vapor discharge outlet connector valve having an inlet connected to said tenth fluid connection and an outlet;

a fifteenth fluid connection connected between said vapor discharge outlet connector and said outlet of said vapor discharge outlet connector valve;

a vapor discharge outlet pump down valve having an inlet connected to said fifteenth fluid connection and an outlet connected to said pump down fluid connection; and a condensed refrigerant outlet pump down valve having an inlet connected to said fourteenth fluid connection and an outlet connected to said pump down fluid connection.

10. A refrigerant processing and transferring system as claimed in claim 9, further comprising:

a liquid refrigerant connector;

a liquid refrigerant inlet connector valve having an inlet and an outlet;

a sixteenth fluid connection connected between said liquid refrigerant connector and the inlet of said liquid refrigerant inlet connector valve;

a second filter and dryer stage having an inlet and an outlet;

a seventeenth fluid connection between the outlet of said liquid refrigerant inlet connector valve and the inlet of said second filter and dryer stage;

a first receiver liquid refrigerant inlet valve having an outlet connected to a liquid refrigerant inlet of said first receiver tank and an inlet;

an eighteenth fluid connection between the outlet of said second filter and dryer stage and the inlet of said first receiver liquid refrigerant inlet valve;

a second receiver liquid refrigerant inlet valve having an inlet connected to said eighteenth fluid connection and an outlet connected to a liquid refrigerant inlet of said second receiver tank;

a first receiver outlet valve having an inlet connected to the liquid refrigerant inlet of said first receiver tank and an outlet connected to said seventeenth fluid connection;

a second receiver outlet valve having an inlet connected to the liquid refrigerant inlet of said second receiver tank and an outlet connected to said seventeenth fluid connection;

a liquid refrigerant outlet valve having an inlet connected to said eighteenth fluid connection and an outlet connected to said sixteenth fluid connection; and a liquid refrigerant pump down valve having an inlet connected to said sixteenth fluid connection and an outlet connected to said pump down fluid connection.

11. A refrigerant processing and transferring system as claimed in claim 10, further comprising:

a first vapor suction outlet valve having an inlet connected to a vapor suction outlet of said first receiver tank and an outlet connected to said second fluid connection;

a second vapor suction outlet valve having an inlet connected to a vapor suction outlet of said second receiver tank and an outlet connected to said second fluid connection;

a first receiver drain connector;

a first receiver drain valve having an inlet connected to a liquid drain outlet of said first receiver tank and an outlet;

a nineteenth fluid connection between the first receiver drain connector and the outlet of said first receiver drain valve;

a second receiver drain connector;

a second receiver drain valve having an inlet connected to a liquid drain outlet of said second receiver tank and an outlet; and a twentieth fluid connection between the second receiver drain connector and the outlet of said second receiver drain valve.

* * * * *